US009273526B2

(12) United States Patent
Oberg et al.

(10) Patent No.: US 9,273,526 B2
(45) Date of Patent: Mar. 1, 2016

(54) DOWNHOLE ANCHORING SYSTEMS AND METHODS OF USING SAME

(71) Applicant: Baker Hughes Incorporated, Houston, TX (US)

(72) Inventors: Levi B. Oberg, Houston, TX (US); Ying Qing Xu, Tomball, TX (US); Gregory L. Hern, Porter, TX (US); Douglas J. Lehr, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 414 days.

(21) Appl. No.: 13/742,395

(22) Filed: Jan. 16, 2013

(65) Prior Publication Data

US 2014/0196889 A1 Jul. 17, 2014

(51) Int. Cl.

| | |
|---|---|
| ***E21B 33/129*** | (2006.01) |
| ***E21B 23/01*** | (2006.01) |
| ***E21B 33/12*** | (2006.01) |

(52) U.S. Cl.

CPC ..... *E21B 23/01* (2013.01); *E21B 33/129* (2013.01); *E21B 33/1216* (2013.01)

(58) Field of Classification Search

CPC ... E21B 33/1216; E21B 23/01; E21B 33/129; E21B 33/1293; E21B 33/1291; E21B 33/1295; E21B 33/1294

See application file for complete search history.

(56) References Cited

U.S. PATENT DOCUMENTS

| | | | |
|---|---|---|---|
| 2,942,666 | A | 6/1960 | True et al. |
| 3,032,116 | A | 5/1962 | Barry |
| 3,057,406 | A | 10/1962 | Patterson et al. |
| 3,083,774 | A | 4/1963 | Peters et al. |
| 3,398,796 | A | 8/1968 | Fisher, Jr. et al. |
| 3,830,296 | A | 8/1974 | Shirley |
| 3,861,465 | A | 1/1975 | Mignotte |
| 4,440,223 | A | 4/1984 | Akkerman |
| 4,706,746 | A | 11/1987 | White et al. |
| 4,949,788 | A | 8/1990 | Szarka et al. |

(Continued)

FOREIGN PATENT DOCUMENTS

| | | | |
|---|---|---|---|
| GB | 2230800 | A | 10/1990 |
| GB | 2394237 | A | 4/2004 |
| WO | WO 03062593 | A1 | 7/2003 |

OTHER PUBLICATIONS

Product Report, ZXP Compression Set Liner Packer, Sep. 2001, Baker Hughes Incorporated, Houston, Texas, USA.

(Continued)

*Primary Examiner* — Blake Michener
*Assistant Examiner* — Kipp Wallace
(74) *Attorney, Agent, or Firm* — Parsons Behle & Latimer

(57) ABSTRACT

Anchoring systems for disposition in wellbores and tubular devices comprise a tubular member defined by two or more radially expandable slip members. The upper ends of the slip members are shaped such that when the slip members are in their respective run-in positions and in their respective set positions, a portion of an upper end of one slip member overlaps a portion of an upper end of another slip member so that the longitudinal space between each slip member that is created when the slip members are in their set position are blocked by the upper end of at least one of the slip members. Thus, in their set position, the upper end of at least one of the slip members provides a back-up to a sealing element that can be disposed adjacent to and in contact with the upper ends of the slip members when in their set positions.

13 Claims, 10 Drawing Sheets

(56) References Cited

U.S. PATENT DOCUMENTS

| | | | | |
|---|---|---|---|---|
| 5,014,782 | A | 5/1991 | Daspit | |
| 5,097,902 | A | 3/1992 | Clark | |
| 5,178,219 | A | 1/1993 | Striech et al. | |
| 5,186,258 | A | 2/1993 | Wood et al. | |
| 5,207,272 | A | 5/1993 | Pringle et al. | |
| 5,236,047 | A | 8/1993 | Pringle et al. | |
| 5,257,663 | A | 11/1993 | Pringle et al. | |
| 5,291,947 | A | 3/1994 | Stracke | |
| 5,320,182 | A | 6/1994 | Mendez | |
| 5,331,607 | A | 7/1994 | Roessler | |
| 5,404,946 | A | 4/1995 | Hess | |
| 5,540,280 | A | 7/1996 | Schultz et al. | |
| 5,577,560 | A | 11/1996 | Coronado et al. | |
| 5,579,838 | A | 12/1996 | Michael | |
| 5,960,881 | A | 10/1999 | Allamon et al. | |
| 6,325,148 | B1 | 12/2001 | Trahan et al. | |
| 6,341,654 | B1 | 1/2002 | Wilson et al. | |
| 6,345,669 | B1 | 2/2002 | Buyers et al. | |
| 6,497,290 | B1 | 12/2002 | Misselbrook et al. | |
| 6,520,257 | B2 | 2/2003 | Allamon et al. | |
| 6,745,845 | B2 | 6/2004 | Cook et al. | |
| 6,752,205 | B2 | 6/2004 | Kutac et al. | |
| 6,779,601 | B2 | 8/2004 | Wilson et al. | |
| 6,834,725 | B2 | 12/2004 | Whanger et al. | |
| 6,886,631 | B2 | 5/2005 | Wilson et al. | |
| 6,915,845 | B2 | 7/2005 | Leising et al. | |
| 6,935,423 | B2 | 8/2005 | Kusmer | |
| 6,976,534 | B2 | 12/2005 | Sutton et al. | |
| 7,100,691 | B2 | 9/2006 | Nguyen et al. | |
| 7,100,710 | B2 | 9/2006 | Vail, III | |
| 7,104,322 | B2 | 9/2006 | Whanger et al. | |
| 7,108,083 | B2 | 9/2006 | Simonds et al. | |
| 7,172,028 | B2 | 2/2007 | Barbee et al. | |
| 7,195,073 | B2 | 3/2007 | Fraser, III | |
| 7,322,410 | B2 | 1/2008 | Vinegar et al. | |
| 7,367,391 | B1 | 5/2008 | Stuart et al. | |
| 7,617,868 | B2 | 11/2009 | Stuart et al. | |
| 7,617,880 | B2 | 11/2009 | Loughlin | |
| 7,921,921 | B2 * | 4/2011 | Bishop et al. | 166/373 |
| 7,938,192 | B2 | 5/2011 | Rytlewski | |
| 2002/0032126 | A1 | 3/2002 | Kusmer | |
| 2003/0131988 | A1 | 7/2003 | Wilson et al. | |
| 2003/0221830 | A1 | 12/2003 | Leising et al. | |
| 2004/0020644 | A1 | 2/2004 | Wilson et al. | |
| 2004/0055749 | A1 | 3/2004 | Lonnes et al. | |
| 2004/0055758 | A1 | 3/2004 | Brezinski et al. | |
| 2004/0112609 | A1 | 6/2004 | Whanger et al. | |
| 2004/0159447 | A1 | 8/2004 | Bissonnette et al. | |
| 2004/0216891 | A1 | 11/2004 | Maguire | |
| 2005/0006106 | A1 | 1/2005 | Hirth et al. | |
| 2005/0126791 | A1 | 6/2005 | Barbee et al. | |
| 2005/0236162 | A1 | 10/2005 | Badrak et al. | |
| 2006/0005963 | A1 * | 1/2006 | Hiorth et al. | 166/196 |
| 2006/0081380 | A1 | 4/2006 | Hoffman et al. | |
| 2007/0102165 | A1 | 5/2007 | Slup et al. | |
| 2007/0107913 | A1 | 5/2007 | Arnold et al. | |
| 2007/0151735 | A1 | 7/2007 | Ravensbergen et al. | |
| 2008/0110625 | A1 | 5/2008 | Arcement et al. | |
| 2008/0190605 | A1 | 8/2008 | Clapp et al. | |
| 2008/0230235 | A1 | 9/2008 | Loughlin | |
| 2008/0264627 | A1 | 10/2008 | Roberts et al. | |
| 2009/0038808 | A1 | 2/2009 | Anderson | |
| 2009/0308656 | A1 | 12/2009 | Chitwood et al. | |
| 2011/0036560 | A1 | 2/2011 | Vail, III et al. | |
| 2011/0036561 | A1 * | 2/2011 | Bishop et al. | 166/134 |
| 2013/0186616 | A1 | 7/2013 | Xu et al. | |
| 2013/0186647 | A1 | 7/2013 | Xu et al. | |
| 2013/0186648 | A1 | 7/2013 | Xu et al. | |
| 2013/0186649 | A1 | 7/2013 | Xu et al. | |

OTHER PUBLICATIONS

Gordon Mackenzie, et al., Wellbore Isolation Intervention Devices Utilizing a Metal-to-Metal Rather Than an Elastomeric Sealing Methodology, Nov. 11-14, 2007, pp. 1-5, SPE 109791, Society of Petroleum Engineers, Inc., U.S.A.

Technical Design's Stroking Pump, Technical Design, p. 1.

TAM SlikPak flyer, TAM International, pp. 1-4.

TAM SlikPak flyer, TAM International, pp. 1-2.

International Searching Authority; ISR & WO issued in PCT/US2013/071682 dated Feb. 25, 2014.

* cited by examiner

DOWNHOLE ANCHORING SYSTEMS AND METHODS OF USING SAME

BACKGROUND

1. Field of Invention

The invention is directed to downhole anchoring systems and, in particular, to downhole anchoring systems having a plurality of slip members arranged relative to each other such that an upper end of at least one of the slip members overlaps the upper end of a second slip member when in the set position.

2. Description of Art

Anchoring systems such as those used in completion systems and other systems of oil and gas wells are known in the art. In general, these anchoring systems are run-in a wellbore in a first or initial position. Once located in the wellbore, the anchoring systems are actuated causing them to radially expand and engage with the inner wall surface of the casing or the formation to become anchored to the wellbore. To facilitate anchoring, the anchoring systems can include one or more slip members.

SUMMARY OF INVENTION

Broadly, the anchoring systems disclosed herein include a tubular member at least partially defined by two or more slip member with a slip surface disposed on an outer wall surface of the slip members. The slip members include an upper end having a particular shape such that when the slip members are in their initial or run-in position and in their various set positions, a portion of the upper end of one slip member overlaps a portion of the upper end of another slip member.

In one particular embodiment, the slip members are moved from their respective run-in positions to their respective set positions by an actuator acting on the tubular member. In one such embodiment, the actuator comprises a swage member which is pushed into a bore of the tubular member causing the slips to move radially outward.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 3:
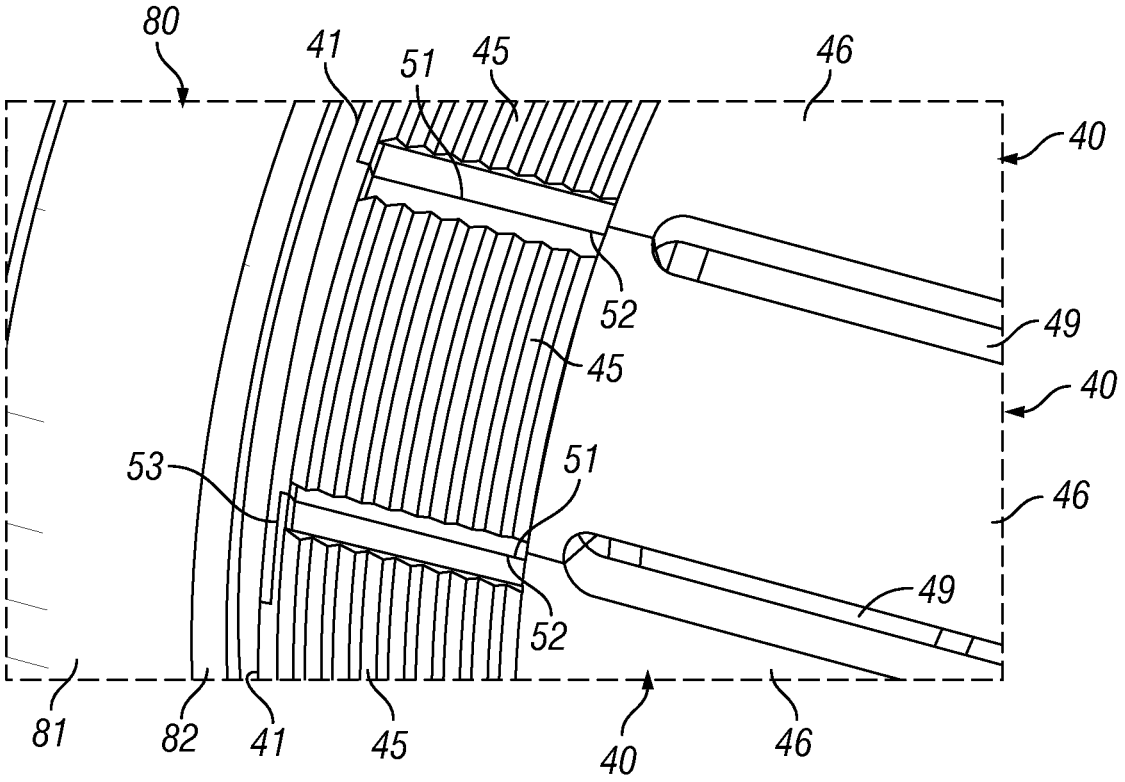
FIG. 3 is an enlarged view of the anchoring system shown in FIG. 1 taken along line 3-3.
Figure 4:
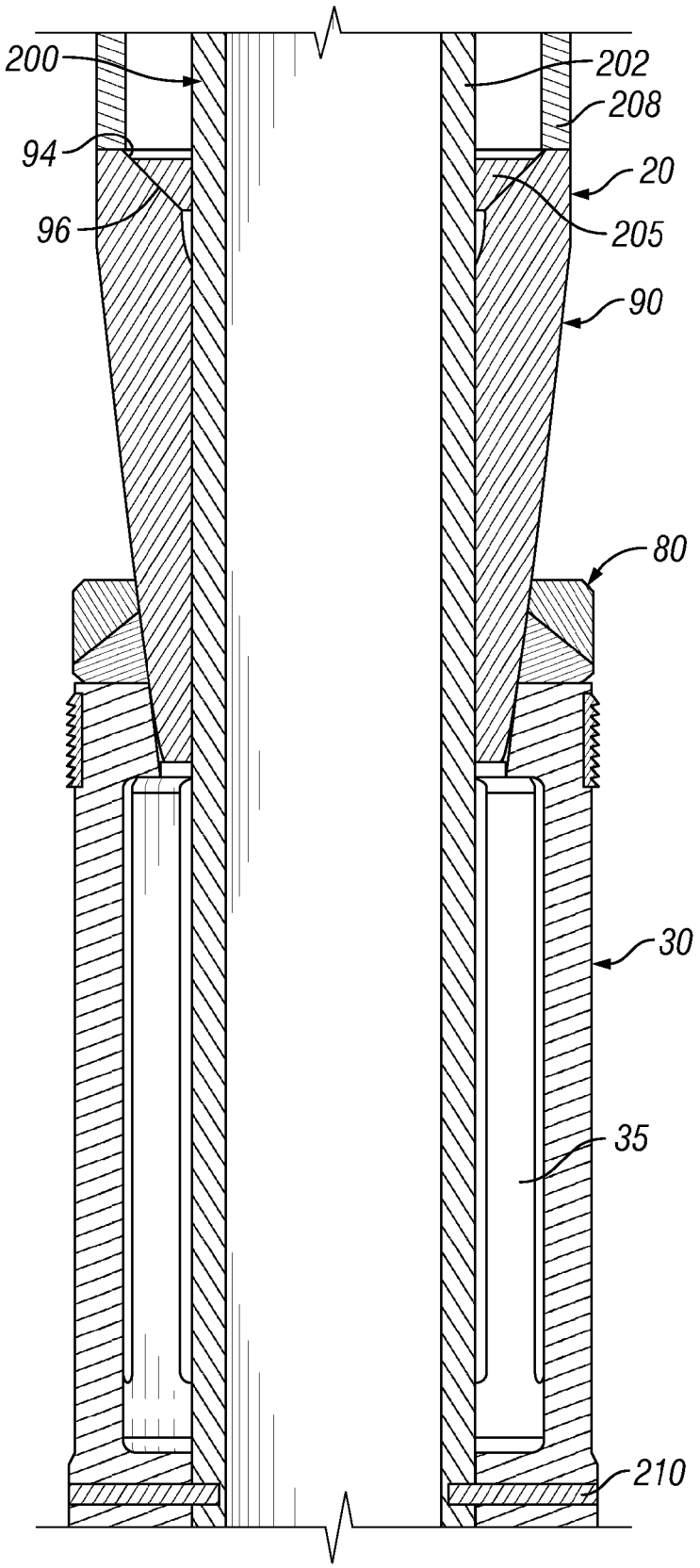
FIG. 4 is a cross-sectional view of the anchoring system of FIG. 1 shown in its run-in position with a setting tool operatively associated with the anchoring system prior to setting the anchoring system.
Figure 5:
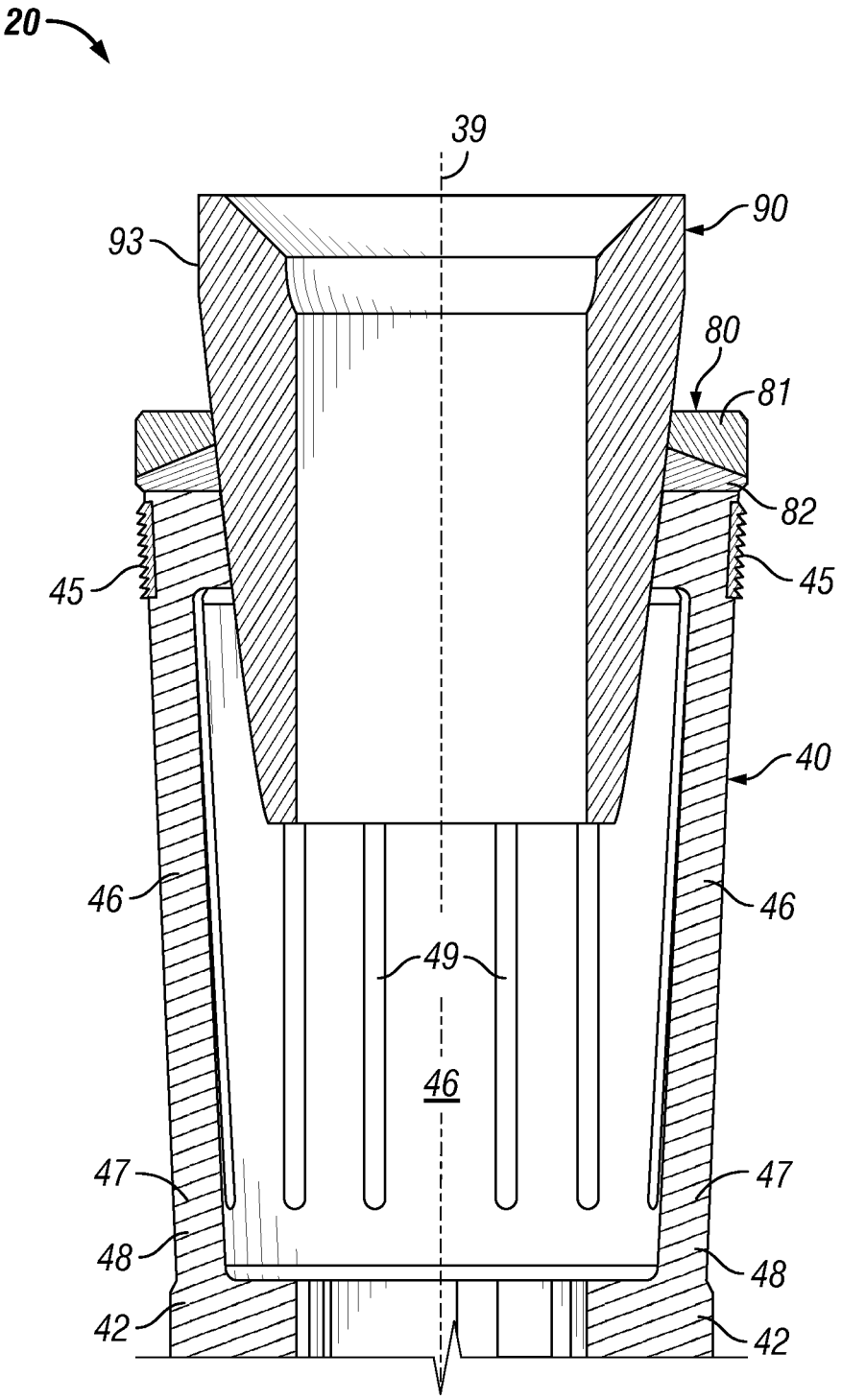
FIG. 5 is a cross-sectional view of the anchoring system of FIG. 1 shown in the set position after removal of the setting tool shown in FIG. 4.

Referring now to FIGS. 1-8, in certain specific embodiments, anchoring system 20 comprises tubular member 30 at least partially defined by a plurality of slip members 40 defining first end 31, second end 32, outer wall surface 33, and inner wall surface 34 defining bore 35. In the embodiment of FIGS. 1-8, the plurality of slip members 40 that can be extended radially outward from an initial, or run-in position (FIGS. 1-4) to their respective set positions (FIG. 5).

Figure 1:
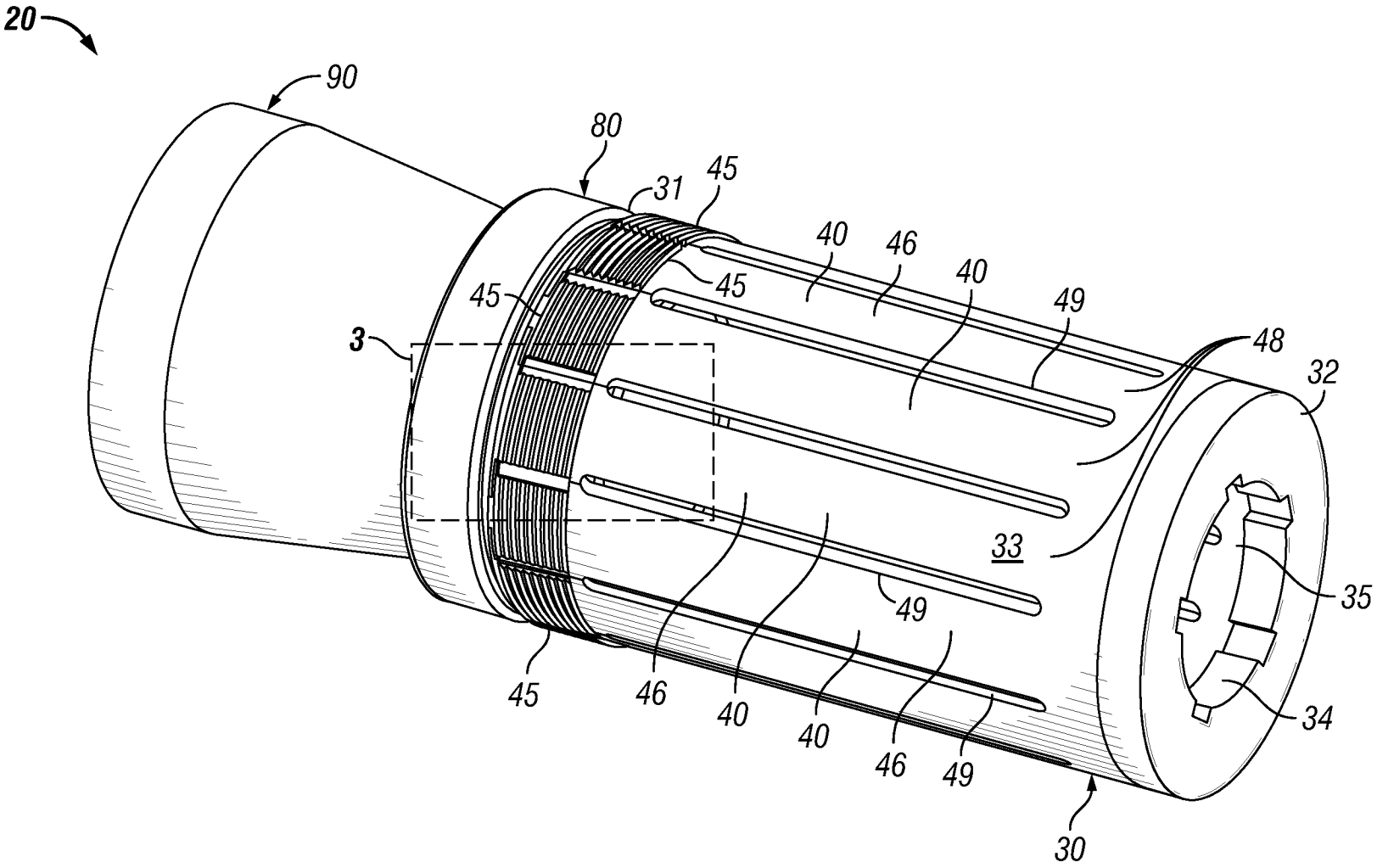
FIG. 1 is a perspective view of one specific embodiment of an anchoring system disclosed herein shown in a run-in position.
Figure 2:
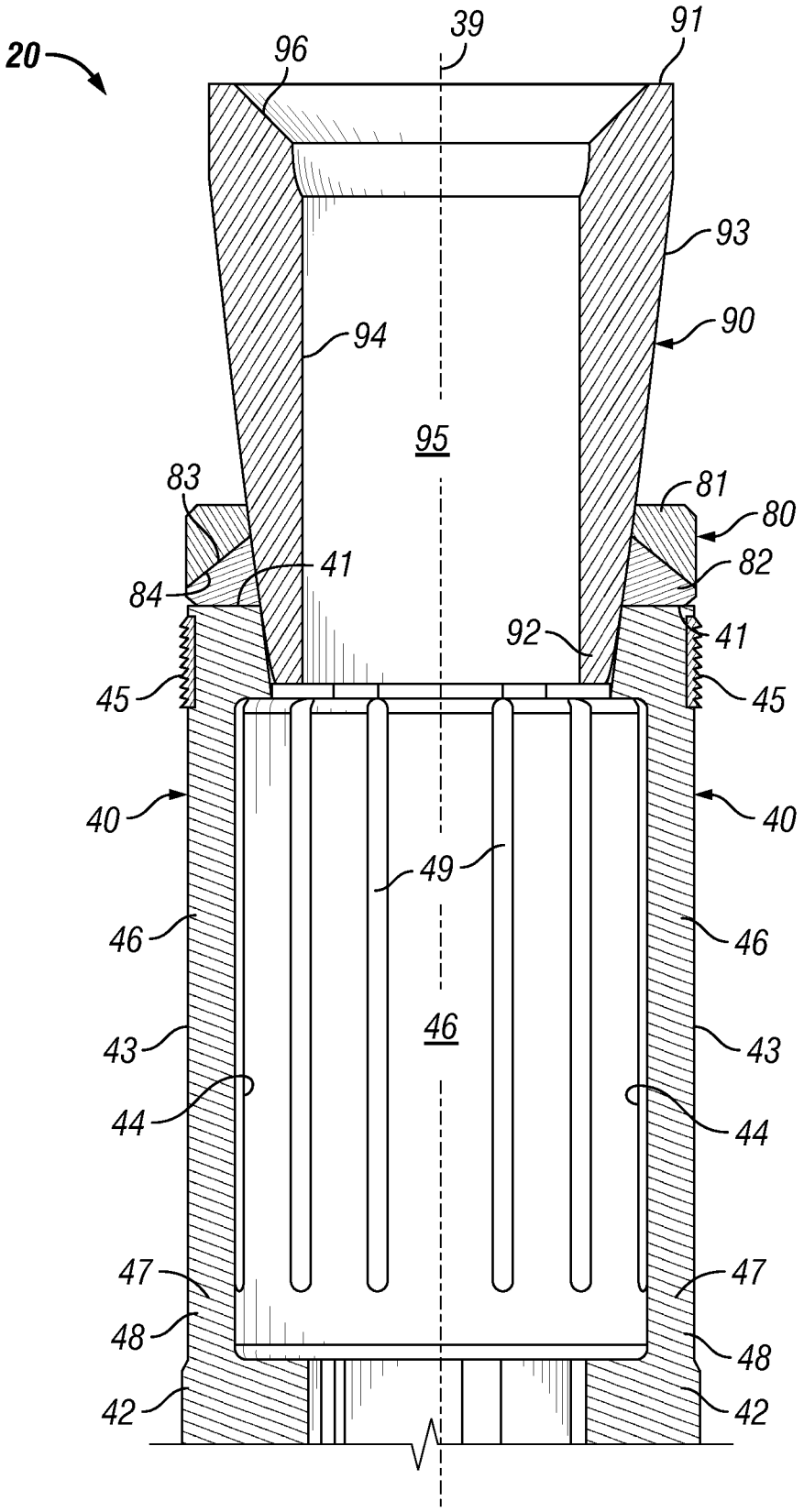
FIG. 2 is a cross-sectional view of the anchoring system of FIG. 1.

In the embodiments of FIGS. 1-8, and illustrated best in FIG. 2, each slip member 40 comprises an upper end 41, a lower end 42, an outer wall surface 43 and an inner wall surface 44. Disposed on a portion of outer wall surface 43 toward upper end 41 is slip surface 45 for engaging an inner wall surface of a wellbore, or other tubular device (not shown). Slip surface 45 can comprise wickers, teeth, or any other device for engaging with, biting into, or anchoring into an inner wall surface of a wellbore or other tubular device.

In the embodiment of FIGS. 1-8, each slip member 40 comprises finger 46 of a collet 29. As a result, movement of slip members 40 radially outward is facilitate by rotating lower end portion 47 of each finger 46 at pivot point 48. Although not required, in the embodiment of FIGS. 1-8, a portion of each finger 46 includes a profile separating adjacent fingers 46 from each other. The profiles define elongated opening 49.

As best shown in FIG. 3, upper ends 41 of slip members 40 are shaped such that when the slip members 40 are in the run-in position (FIGS. 1-4), a portion of sides 51, 52 of adjacent slip members 40 disposed toward upper ends 41 of slip members 40 are engaged with one another. In other words, elongated openings 49 do not extend to upper ends 41.

In addition, upper ends 41 include a profile such that a portion of the upper end 41 of one slip member 40 overlaps the upper end 41 of an adjacent slip member 40 in both the run-in position and the set position. With specific reference to FIGS. 3 and 6-7, in one particular embodiment, an upper end 41 of one slip member 40 overlaps a portion of an upper end of an adjacent slip member 40 by projection 53. In the embodiments of FIGS. 1-7, projection 53 extends from a side of one slip member 40 and is in sliding engagement with upper end 41 of an adjacent slip member 40. In the embodiment of FIGS. 1-7, the adjacent slip member 40 (illustrated best in FIG. 7) includes a detent or tab 58 that engages with projection 53 from the adjacent slip member 40 when the slip members 40 are in the run-in position.

Figure 6:
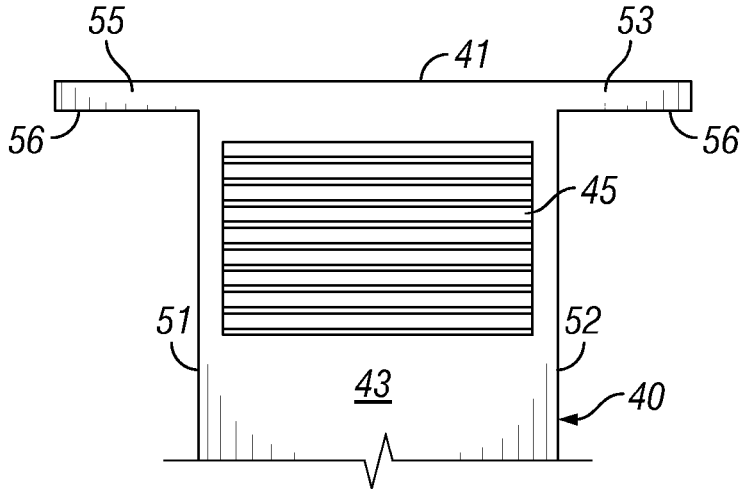
FIG. 6 is a partial perspective view of one specific slip member for inclusion with the anchoring systems shown in FIG. 1.

As best illustrated in FIG. 6, certain slip members 40 of the embodiment of FIGS. 1-7 includes upper end 41 having first projection 53 and second projection 55 each extending outwardly from sides 51, 52. Bottom surfaces 56 of projections 53, 55 overlap the upper ends of the slip members disposed adjacent slip member 40, i.e., disposed to the left and right of slip member 40 (shown in FIGS. 1-5). Projections 53, 55 can overlap the upper ends of the adjacent slip members as much as necessary or desired to facilitate radial expansion of slip members 40, yet result in a portion of the overlapped upper end remaining at least partially overlapped by projections 53, 55. In other words, projections 53, 55 are designed such that a gap is not formed at the upper end between adjacent slip members 40 as normally would result due to the radial expansion of slip members 40. Instead, when in the set position, the gap formed between adjacent slip members 40 is "closed-off" or "covered" by projections 53, 55 extending over the gap and remaining in contact with upper end 41 of adjacent slip members 40.

Figure 7:
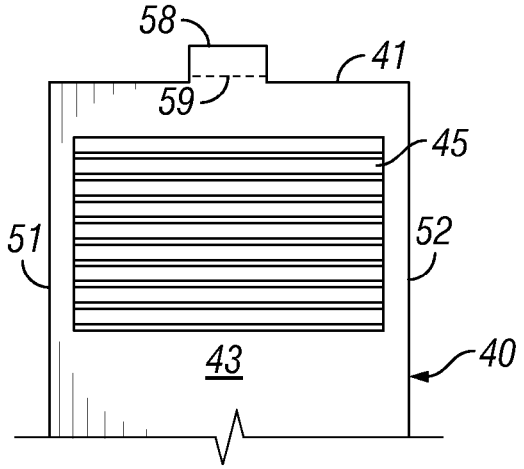
FIG. 7 is a partial perspective view of another specific slip member for inclusion with the anchoring systems shown in FIG. 1.

As mentioned above, in the embodiment of FIGS. 1-7 certain slip members 40 do not include one or both projections 53, 55. Instead, as shown in FIG. 7, certain slip members 40 include detent or tab 58 disposed at center point 59 of upper end 41. "Center point" is the median point along the width of upper end 41, i.e., equidistant from sides 51, 52. Detent 58 fills in a gap disposed between the ends of projections 53, 55 from adjacent slip members 40.

Figure 8:
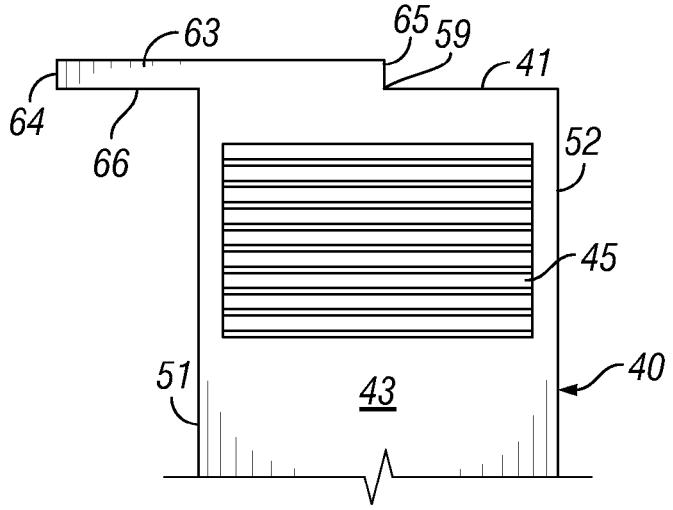
FIG. 8 is a partial perspective view of an additional specific slip member for inclusion with the anchoring systems disclosed herein.
Figure 9:
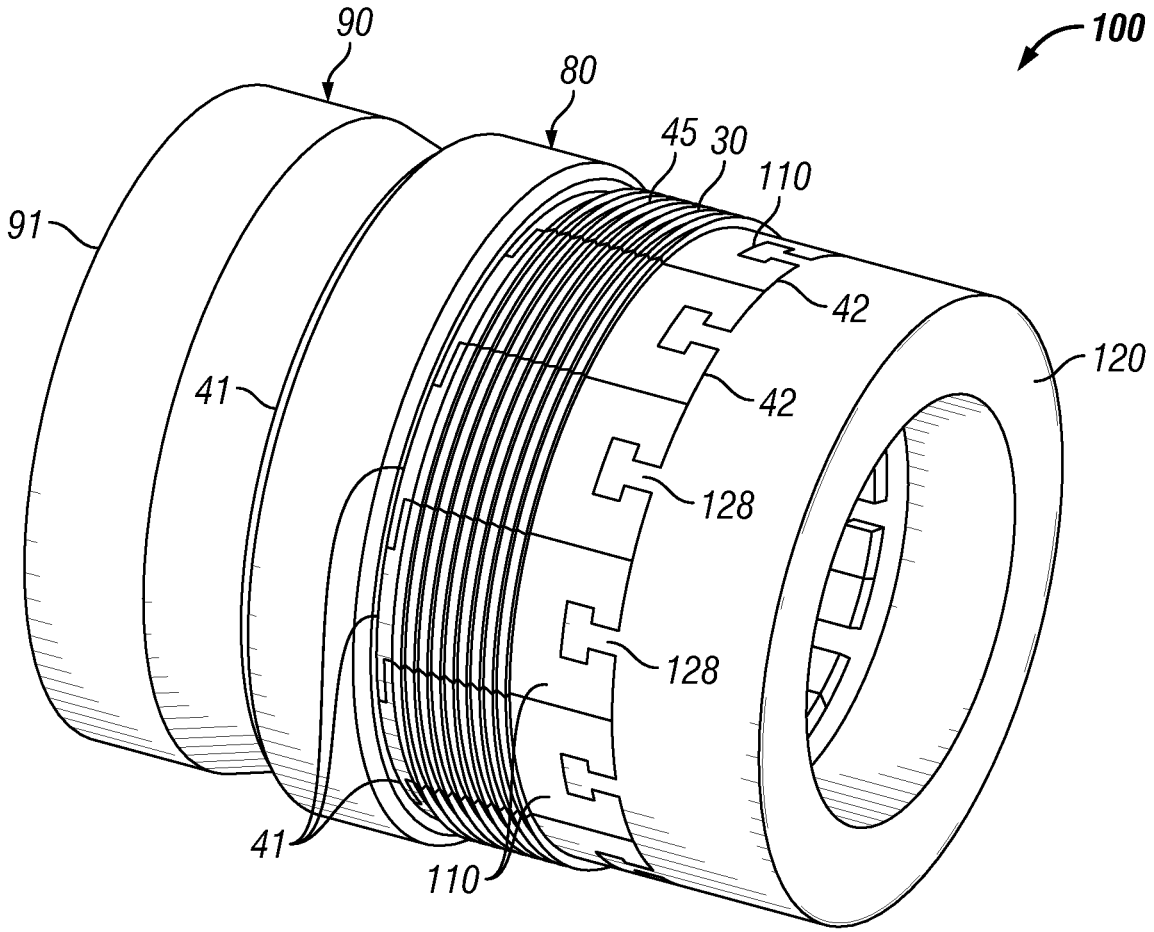
FIG. 9 is a perspective view of another specific embodiment of an anchoring system disclosed herein shown in a run-in position.
Figure 10:
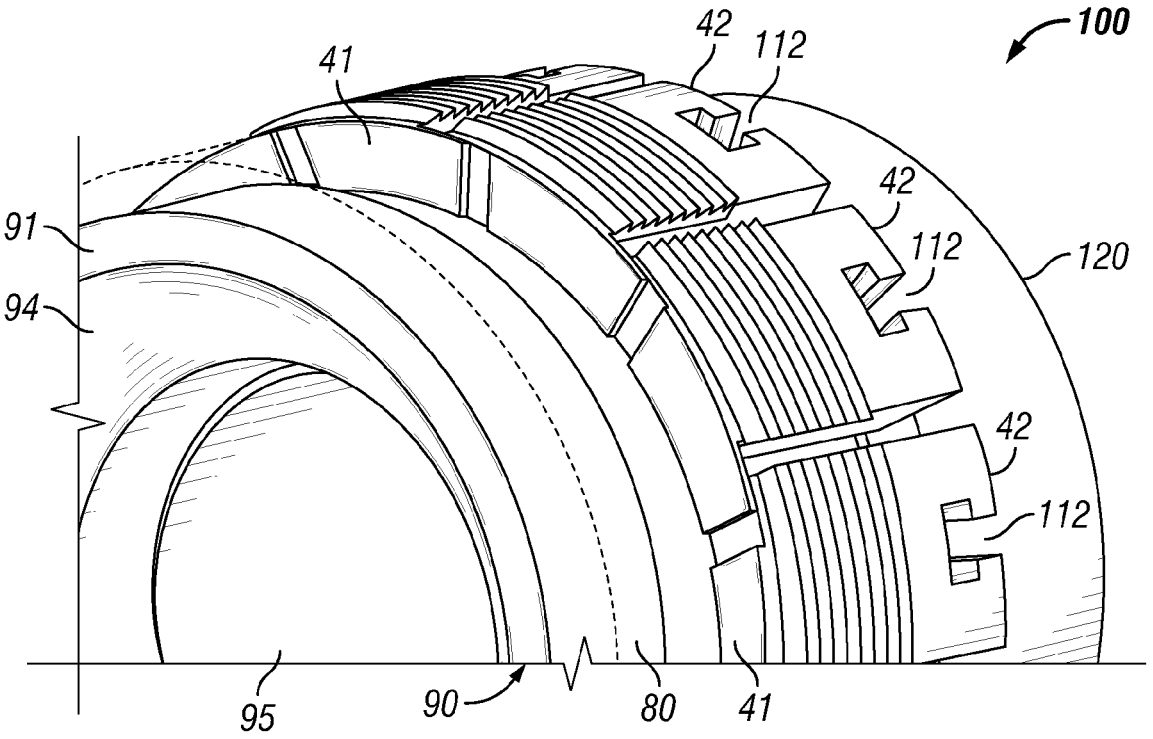
FIG. 10 is a partial perspective view of the anchoring system of FIG. 9.

In other embodiments of slip members 40, such as shown in FIG. 8, each slip member 40 can be identically designed having a single projection 63 extending outwardly from side 51 or side 52. In the embodiment of FIG. 8, projection 63 extends outwardly from side 51. Projection 63 has first end 64 that overlaps an adjacent slip member and second end 65 that is disposed along upper end 41 of slip member 40. Bottom surface 66 of projection 63 overlaps the upper end of the slip member disposed adjacent slip member 40, i.e., disposed to the left of slip member 40 shown in FIG. 8. Second end 65 can be disposed along any point of upper end 41 that is desired or necessary to facilitate projection 63 maintaining an overlapped relationship or arrangement with an adjacent slip member when in both the run-in and set positions. In the embodiment shown in FIG. 8, second end 65 is disposed at center point 59 of upper end 41.

In the embodiments of FIGS. 1-5, anchoring system 20 further includes sealing element 80 disposed along first end 31 of tubular member 30. Although sealing element 80 can be any sealing element known in the art and can be formed from any material known in the art, sealing element 80 of the embodiments of FIGS. 1-5 comprises an elastomeric first member 81 and an elastomeric second member 82 in sliding engagement with each other along ramp surfaces 83, 84. Thus, when radially expanded, first member 81 slides or cams along second member 82 to facilitate the radial expansion and creating of a seal with an inner wall surface of the wellbore or other tubular device (not shown).

Actuator 90 is operatively associated with tubular member 30 and sealing element 80 such that actuator 90 moves tubular member 30 from its run-in position (FIGS. 1-4) to its set position (FIG. 5). In the embodiments of FIGS. 1-8, actuator 90 comprises a swage having a frustoconical shape. Thus, actuator 90 comprises first end 91, second end 92, conically-shaped outer wall surface 93, and inner wall surface 94 defining bore 95. Inner wall surface 94 includes landing surface 96 at first end 91 for receiving a plug element such as a ball (not shown) which can be landed on and forced into landing surface 96 to facilitate movement of actuator 90 downward into bore 35.

In operation of the embodiment of FIGS. 1-7, setting tool 200 (FIG. 4) is operatively associated with anchoring system 20. As illustrated in FIG. 4, setting tool 200 includes mandrel 202, upper plate 205, collar 208, and releasable member 210. Mandrel 202 is initially disposed through bore 95 of actuator and bore 35 of tubular member 30 and is releasably secured to tubular member 30 by releasable member 210. Upper plate 205 is secured to the outer wall surface of mandrel 202 and is shaped to fit within bore 95 of actuator 90 and engage a portion of inner wall surface 94 of actuator 90 to prevent actuator 90 from moving upward. In the embodiment shown in FIG. 4, plate 205 is landed on landing surface 96. Collar 208 is in sliding engagement with the outer wall surface of mandrel 202.

Releasable member 210 can be any device known in the art. Suitable releasable members 210 include shear devices such as shear screws or shear pins. Releasable member 210 allows the upward movement of mandrel 202 to cause tubular member 30 to move upward along outer wall surface 93 of actuator 90 until a predetermined force is encountered at which time releasable member 210 is compromised, e.g., broken, so that mandrel 202 can continue to be moved upward out of bore 35 of tubular member 30.

After anchoring device 20 is located within a wellbore at the desired depth, mandrel 202 is moved upward. In so doing, upper end 91 of actuator 90 is forced into collar 208. Collar 208 prevents actuator 90 from moving upward. Mandrel 202 is moved upward through collar 208. In so doing, tubular member 30 is moved upward due to the connection of mandrel 202 with tubular member 30 through releasable member 210. As result, tubular member 30 is moved over actuator 90 by sliding slip members 40 along outer wall surface 93 of actuator causing slip members 40 to move from their run-in positions to their respective set positions. In the specific embodiment of FIGS. 1-7, collet fingers 46 rotate outwardly about pivot point 48 so that upper ends 41 and, thus, slip surfaces 45 are pushed radially outward away from longitudinal axis 39. The upward movement of mandrel 202 and, thus tubular member 30, causes actuator 90 to compress and radially expand sealing element 80. Mandrel 202 is continued to be moved upward out of bore 35 of tubular member 30 until sealing element 80 seals against the inner wall surface of the wellbore or tubular device (not shown) and slip members 40 engage with and bite into, or anchor into, or otherwise secure themselves to the inner wall surface of the wellbore or tubular device.

During radial expansion of slip members 40, bottom surfaces 56 of projections 53, 55 of certain slip members 40 slide along upper end 41 of slip members 40 disposed adjacent these slip members 40. As illustrated in FIG. 5, upon reaching their respective set positions, a portion of projection 53 and projection 55 remain in an overlapping arrangement with the adjacent slip members 40. As a result, the gap between sides 51, 53 of adjacent slip members 40 is not continuous through upper ends 41 of the adjacent slip members. Therefore, the upper ends 41, when slip members 40 are in their respective set positions, provide a barrier between these gaps and sealing element 80. In so doing, upper ends 41 of slip members 40 provide a back-up to sealing element 80 to facilitate sealing element 80 creating a seal with the inner wall surface of the wellbore. In addition, upon reaching the set positions, releasable member 210 is compromises such that mandrel 202 is movable independent from tubular member 30.

After slip members 40 and sealing element 80 are placed in their respective set positions, and releasable member 210 is compromised, mandrel 202 can be moved upward out of bore 35 and bore 95 and mandrel 202 and collar 208 ultimately can be removed from the wellbore, leaving anchoring system 20 disposed within the wellbore for use in further operations, e.g., landing a plug element on landing surface 96 to pressurize the wellbore to actuate another tool, engage in fracking operations, or engage in any other intervention operations.

Figure 13:
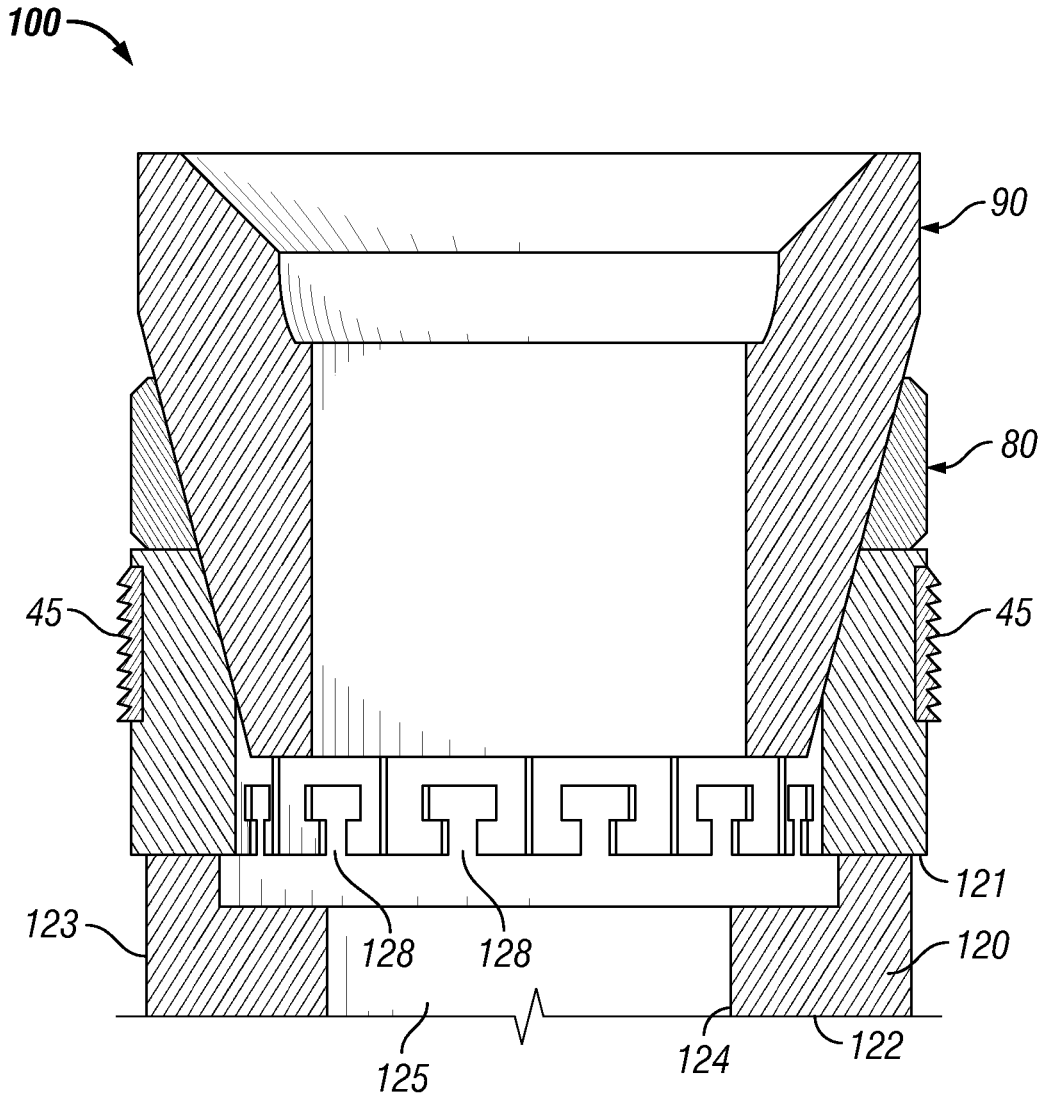
FIG. 13 is a cross-sectional view of the anchoring system shown in FIG. 9 shown in the set position after removal of the setting tool shown in FIG. 12.

Referring now to FIGS. 9-13, in another embodiment, anchoring system 100 comprises a plurality of slip members 110 having many of the same structures discussed above and are referred to with respect to the embodiments of FIGS. 9-13 with like reference numerals. As shown in FIGS. 9-10 and 12-13, lower ends 42 of each slip member 110 is operatively associated with slip carrier 120. As best shown in FIG. 13, slip carrier 120 comprises upper end 121, lower end 122, outer wall surface 123, and inner wall surface 124 defining bore 125.

Figure 11:
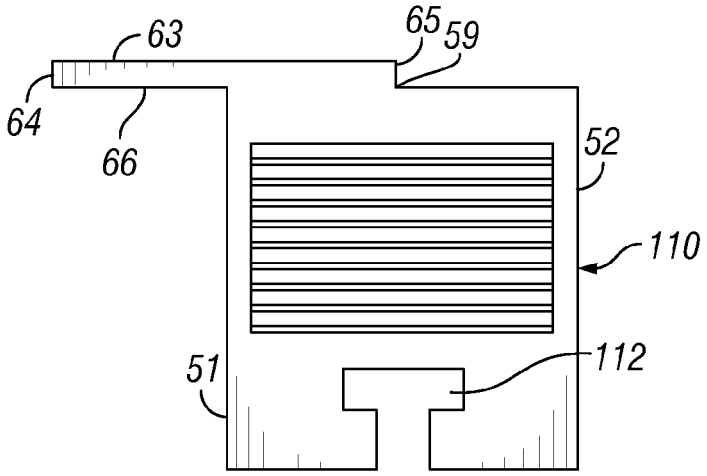
FIG. 11 is a partial perspective view of one specific slip member for inclusion with the anchoring systems shown in FIG. 9.
Figure 12:
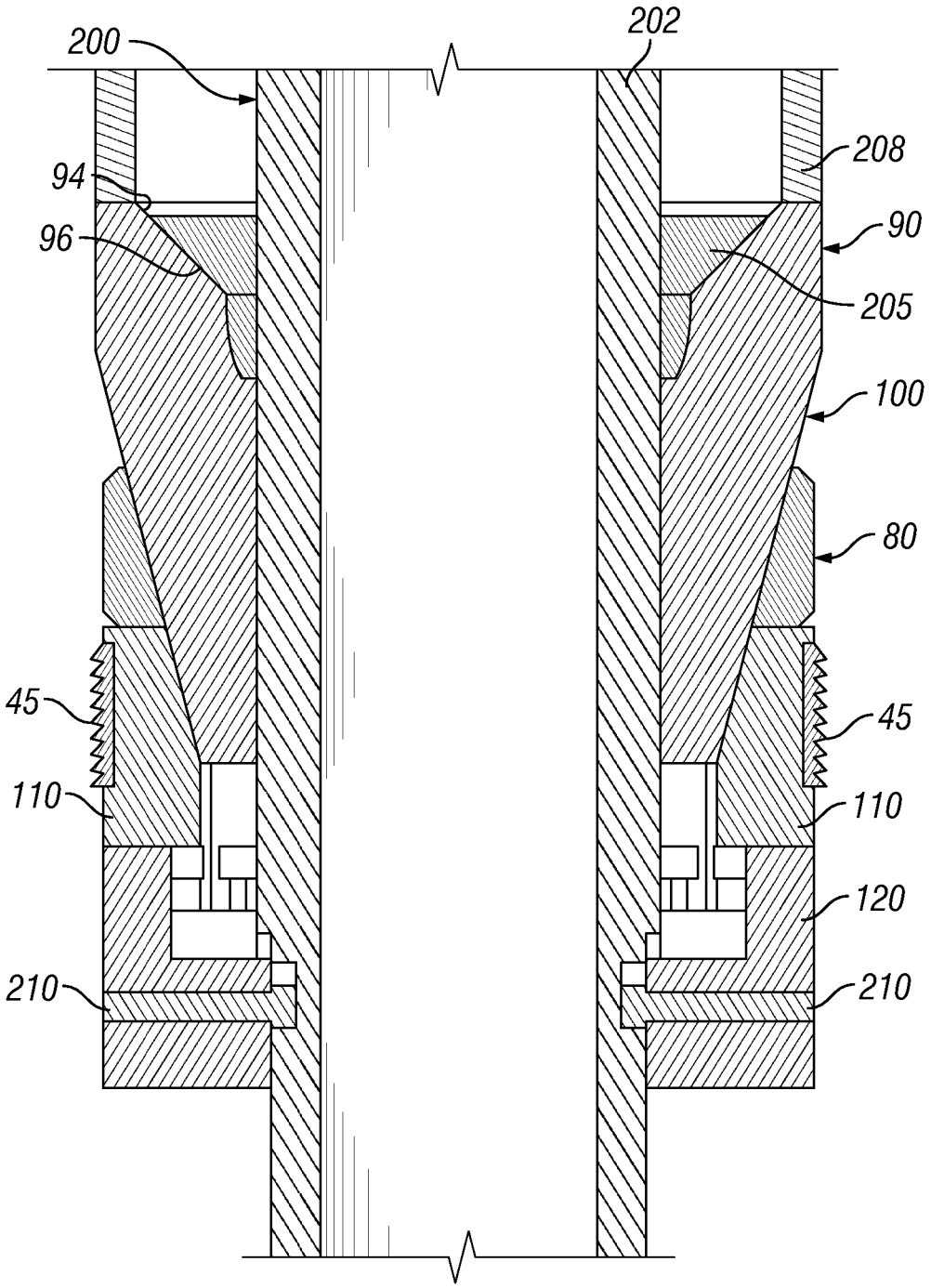
FIG. 12 is a cross-sectional view of the anchoring system of FIG. 9 shown in its run-in position with a setting tool operatively associated with the anchoring system prior to setting the anchoring system.

Upper ends 41 of slip members 110 are identical to upper ends 41 of slip members 40 shown in FIG. 8. Briefly, as best illustrated in FIG. 11, upper ends 41 of slip members 110 include a single projection 63 having ends 64, 65 and bottom surface 66, and disposed relative to center point 59 in the same manner as discussed above with respect to FIG. 8.

Unlike slip members 40 discussed above with respect to FIGS. 1-8, lower ends 42 of each slip member 110 includes engagement profile 112 that is in sliding engagement with slip carrier profile 128 disposed on upper end 121 of slip carrier 120. Although engagement profile 112 to shown as a "T" shape cut completely through slip member 110, it is to be understood that engagement profile 112 is not required to have a "T" shape, nor is it required to be cut completely through slip member 100. Instead, the shape of engagement profile can be any other shape that facilitates slip member 112 sliding along a slip carrier profile such as slip carrier profile 128 of slip carrier 120 from the run-in position (FIGS. 9, 10, and 12) to the set position (FIG. 13). Similarly, engagement profile 112 can be disposed in lower end 42 of slip member 110 such that inward sliding movement is stopped, for example by engagement profile 112 not being cut all the way through outer wall surface 43 of slip member 110, or by a detent or other stop disposed within engagement profile 112 that prevents slip member 110 from sliding inwardly past a certain point.

In the embodiments of FIGS. 9-13, sealing element 80, discussed in greater detail above with respect to the embodiments of FIGS. 1-8, is disposed adjacent upper ends 41 of slip members 110 (shown in dotted lines in FIG. 10) and is expanded into its set position in the same manner as discussed above with respect to the embodiments of FIGS. 1-8. In particular, tubular member 30 (formed by a plurality of slip members 110), is moved over outer wall surface 93 of actuator 90 (discussed in greater detail above with respect to FIGS. 1-8 causing sealing element 80 to be compressed and extrude radially outward until in engages and seals against the inner wall surface of the wellbore or tubular device (not shown). As tubular member 30 moves upward over actuator 90, individual slip members 110 slide radially outward along engagement profile 112 and slip carrier profile 128 so that slip surface 45 of slip member 110 engages and bites into, or anchors into, the inner wall surface of the wellbore.

To assist the movement of tubular member 30 to move sealing element 80 and slip members 110 from their respective run-in positions to their respective set positions, setting tool 200 (FIG. 12) as discussed above with respect to the embodiments of FIGS. 1-8 is releasably secured to slip carrier 120 by releasable member 210. Setting tool 200 is moved upward through bore 95 of actuator 90 and bore 35 of tubular member 30 in the same manner as discussed above. In so doing, actuator 90 is forced into bore 35 of tubular member 30. The upward movement of tubular member 30 moves sealing element 80 and slip members 110 into their respective set positions. In addition, releasable member 210 is compromised causing setting tool 200 to be freed from slip carrier 120. As a result, setting tool 200 can be withdrawn from bore 35 of tubular member 30 and bore 95 of actuator 90 and, thus, from the wellbore leaving anchoring system 20 within the wellbore for future downhole operations, e.g., landing a ball on actuator 90 to pressure up the wellbore above anchoring system 20.

It is to be understood that the invention is not limited to the exact details of construction, operation, exact materials, or embodiments shown and described, as modifications and equivalents will be apparent to one skilled in the art. For example, a projection of one slip member is not required to overlap an adjacent slip member such that the end of the projection reaches the center point of the upper end of the adjacent slip member. Nor are the projections required to have the arrangements shown in the Figures. To the contrary, the projection only needs to remain overlapping with the adjacent slip member so that the gap between the two slip members is "covered" by the projection. Thus, the shape and dimensions of the projection can be modified as desired or necessary and are not limited to the shape and dimensions of the embodiments shown in the Figures. Moreover, the mechanism for radially expanding the slip members into engagement with the inner wall surface of the wellbore or tubular device is not required to be performed by a swage. Nor are the slip members required to rotate outwardly at a pivot point at one end, or by sliding along a profile as shown in the Figures. To the contrary, the slip members can be carried on any suitable carrier device that can facilitate radial expansion of the slip members outwardly into the inner wall surface of the wellbore. Further, the engagement profiles and slip carrier profiles, if present, are not required to have a "T" shape as shown in the Figures, but can have any other shape or profile desired or necessary to facilitate radial expansion of the slip members outwardly into the inner wall surface of the wellbore or tubular device. Additionally, not all of the slip members are required to be radially extended or expanded. To the contrary, one or more slip members can be designed such that anchoring to the inner wall surface of the wellbore or other tubular device is not achieved. In such embodiments, fluids are permitted to flow past the anchoring system.

Moreover, it is to be understood that the term "wellbore" as used herein includes open-hole, cased, or any other type of wellbores. In addition, the use of the term "well" is to be understood to have the same meaning as "wellbore." Moreover, in all of the embodiments discussed herein, upward, toward the surface of the well (not shown), is toward the top of Figures, and downward or downhole (the direction going away from the surface of the well) is toward the bottom of the Figures. However, it is to be understood that the tools may have their positions rotated in either direction any number of degrees. Accordingly, the tools can be used in any number of orientations easily determinable and adaptable to persons of ordinary skill in the art. Moreover, the mandrel and the shroud can be formed from a single unitary tubular member. Accordingly, the invention is therefore to be limited only by the scope of the appended claims.

What is claimed is:

1. An anchoring system for wellbores, the anchoring system comprising:

a tubular member having a first end, a second end, a longitudinal axis, an outer wall surface, a bore, a first slip member, and a second slip member, the first and second slip members being movable radially outward from the axis of the tubular member from a run-in position to a set position, wherein the tubular member comprises a collet and each of the first and second slip members are disposed on separate collet fingers, wherein the first slip member comprises a first projection at an upper end of the first slip member, the first projection extending over a first portion of an upper end of the second slip member when the first and second slip members are in their respective run-in positions and, the first projection extending over a second portion of the upper end of the second slip member when the first and second slip members are in their respective set positions, wherein the second slip member includes a detent disposed on the upper end of the second slip member, the detent being in sliding engagement with the first projection of the first slip member when the first and second slip members are in their respective run-in positions, and wherein the detent is disposed in alignment with a center point of the upper end of the second slip member.

2. The anchoring system of claim 1, wherein the first slip member is disposed adjacent the second slip member.

3. The anchoring system of claim 1, wherein the first projection of the first slip member is in sliding engagement with the upper end of the second slip member.

4. The anchoring system of claim 1, wherein the first slip member further comprises a second projection, the second projection extending over a first portion of an upper end of a third slip member when the first and third slip members are in their respective run-in positions and, the second projection extending over a second portion of the upper end of the third slip member when the first and third slip members are in their respective set positions.

5. The anchoring system of claim 4, wherein the second projection is in sliding engagement with the upper end of the third slip member.

6. The anchoring system of claim 5, wherein the first and second projections include ends, the end of the first projection aligning with a center point of the upper end of the second slip member when the first and second slip members are in their respective run-in positions, and the second projection aligning with a center point of the upper end of the third slip member when the first and third slip members are in their respective run-in positions.

7. The anchoring system of claim 1, wherein the second slip member comprises a second projection, the second projection extending over a first portion of an upper end of a third slip member when the second and third slip members are in their respective run-in positions and, the second projection extending over a second portion of the upper end of the third slip member when the second and third slip members are in their respective set positions.

8. The anchoring system of claim 7, wherein the second projection is in sliding engagement with the upper end of the third slip member.

9. The anchoring system of claim 8, wherein the first and second projections include ends, the end of the first projection aligning with a center point of the upper end of the second slip member when the first and second slip members are in their respective run-in positions, and the second projection aligning with a center point of the upper end of the third slip member when the second and third slip members are in their respective run-in positions.

10. The anchoring system of claim 1, wherein the first end of the tubular member is operatively associated with a sealing element, and the first projection is operatively associated with the sealing element to provide support to the sealing element when the first slip member is in its set position.

11. The anchoring system of claim 1, wherein the first and second slip members each further comprise a lower end, the lower ends comprising an engagement profile in sliding engagement with a corresponding slip carrier profile disposed on a slip carrier.

12. The anchoring system of claim 11, wherein the slip carrier comprises a tubular member having an upper end, a lower end, an outer wall surface, and an inner wall surface defining a bore, wherein the slip carrier profiles are disposed along the upper end of the slip carrier and have a shape that is reciprocal to a shape of the engagement profiles disposed at the lower ends of the first and second slip members.

13. An anchoring system for wellbores, the anchoring system comprising:

a tubular member having a first end, a second end, a longitudinal axis, an outer wall surface, a bore, a first slip member, and a second slip member, the first and second slip members being movable radially outward from the axis of the tubular member from a run-in position to a set position;

wherein the first slip member comprises a first projection at an upper end of the first slip member, the first projection extending over a first portion of an upper end of the second slip member when the first and second slip members are in their respective run-in positions and, the first projection extending over a second portion of the upper end of the second slip member when the first and second slip members are in their respective set positions;

wherein the first slip member further comprises a second projection, the second projection extending over a first portion of an upper end of a third slip member when the first and third slip members are in their respective run-in positions and, the second projection extending over a second portion of the upper end of the third slip member when the first and third slip members are in their respective set positions;

wherein the second projection is in sliding engagement with the upper end of the third slip member;

wherein the second slip member includes a tab fixedly attached to upper end of the second slip member, the tab being in sliding engagement with the first projection of the first slip member when the first and second slip members are in their respective run-in positions, and wherein the tab is disposed in alignment with a center point of the upper end of the second slip member; and wherein the third slip member includes a tab fixedly attached to upper end of the third slip member, the tab being in sliding engagement with the second projection of the first slip member when the first and third slip members are in their respective run-in positions, and wherein the tab is disposed in alignment with a center point of the upper end of the third slip member.

* * * * *